United States Patent [19]

Sandhu

[11] 4,052,069

[45] Oct. 4, 1977

[54] BOARD GAME APPARATUS

[76] Inventor: Shamir Singh Sandhu, 2320 Acton St., Berkeley, Calif. 94702

[21] Appl. No.: 684,556

[22] Filed: May 7, 1976

[51] Int. Cl.[2] ..... A63F 3/02

[52] U.S. Cl. ..... 273/131 AB; 273/131 K; 273/131 KP; 273/131 R

[58] Field of Search ..... 273/131

[56] References Cited

U.S. PATENT DOCUMENTS

| | | | |
|---|---|---|---|
| 2,610,060 | 9/1952 | Powell | 273/131 K |
| 3,843,130 | 10/1974 | Whitney | 273/131 KP |

FOREIGN PATENT DOCUMENTS

| | | | |
|---|---|---|---|
| 18,266 | 11/1895 | United Kingdom | 273/131 K |

*Primary Examiner*—Delbert B. Lowe
*Attorney, Agent, or Firm*—Robert R. Tipton

[57] ABSTRACT

A game of skill between two opponents uses a playing board having a playing field divided into one hundred squares arranged in rows, columns and diagonals in which two sets of twenty-two playing pieces each are moved along the squares in row, column and diagonal directions, and with individual pieces of a distinctive shape, each for moving in a particular manner on the game board apparatus to capture the opponent's pieces. An extra row of squares or "cells" is provided for each of the two opponents on which are indicia indicating the position and placement of captured pieces which are freed by Sapahis (soldiers of the Maharaja) reaching the opposite side of the board.

1 Claim, 9 Drawing Figures

MAHARAJA

RANI

SHAHZADA

JOTSHI

SWAR

GOLI

RATHWAN

SAPAHI

BOARD GAME APPARATUS

BACKGROUND OF THE INVENTION

This invention relates generally to games of skill and in particular to games using playing pieces representing persons of power having different functions as to movement and capturing of an opponent's pieces.

Similar games of the prior art include checkers and chess in which the playing pieces represent individuals having certain powers to move about on the playing board and capture the opponent's pieces.

SUMMARY OF THE INVENTION

The game apparatus of the present invention comprises, basically, a playing board having a playing field of one hundred squares arranged in ten rows and ten columns in an ordered array of rows, columns and diagonals, plus two extra rows, one for each opposing player, of squares or "cells" containing indicia for placement of captured pieces, with two sets of twenty-two player pieces each moving according to individual rules along the rows and columns and in diagonal directions, with the first piece for moving one square in any direction, a second piece for moving any number of squares in any unobstructed direction and also a combined move of moving one square along a row or column in any obstructed (or unobstructed) direction and then one square diagonally away from the beginning square of said move for landing on an unobstructed square or for capture of an opponent's piece in the last square of the move, two pieces for moving in any unobstructed row, column or diagonal direction, two pieces for a two step move, first one square along a column or row in any obstructed (or unobstructed) direction, and then one square diagonally away from the beginning square of said move and landing on an unobstructed square or for capture of an opponent's piece in that last square of the move, two pieces for moving in any unobstructed direction along rows and columns, two pieces for moving in any unobstructed direction along diagonals, two pieces for moving only one square in any direction and ten pieces for moving along a column in one direction toward the opponent's side and for capturing an opponent's piece by moving diagonally forward one square.

Two extra columns, one on each side of the board, are provided for the purpose of extending the capture rows or "cells" for an additional two playing pieces.

It is, therefore, an object of the present invention to provide a game of skill.

It is a further object of the present invention to provide a game of skill having individual playing pieces which function as individuals having various powers to move in various directions on said playing board.

It is another object of the present invention to provide a game of skill in which a row of "cells" is provided for each opponent having inidicia thereon for placement of captured pieces.

These and other objects of the present invention will be manifest upon study of the following detailed description when taken together with the drawings.

DESCRIPTION OF THE PREFERRED EMBODIMENT

Figure 1:
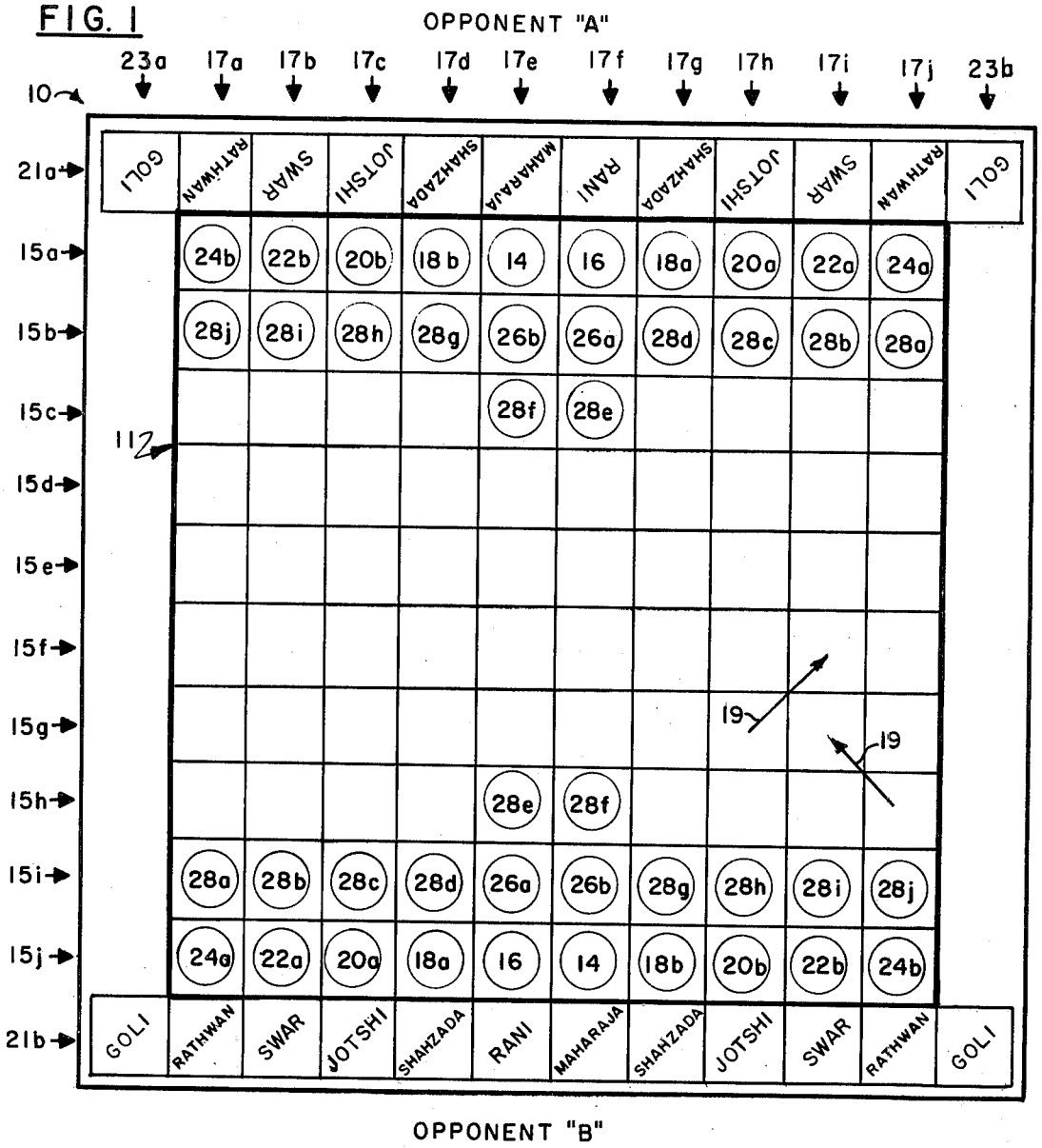
FIG. 1 is a plan view of the game board of the present invention, showing the initial positions of the playing pieces.

With reference to FIG. 1, there is illustrated a plan view of the game board 10 of the present invention showing the position of each of the playing pieces at the beginning of play. The object of the game is to win by capturing the opponent's Maharaja 14. This capture is never consumated. Instead, the game is considered won when the opponent's Maharaja 14 is attacked and he finds no escape.

The game of the present invention comprises, basically, a game board 10 comprising a playing field 11 of one hundred squares arranged in ten rows 15*a* through 15*j* and ten columns 17*a* through 17*j* which also form diagonals as indicated by arrows 19. A capture row 21*a* and 21*b* is provided for each opponent, which row contains indicia in each square or "cell" showing where the captured piece must be placed. In order to provide a square game board 10, two extra columns of squares 23*a* and 23*b* are provided on each side of the board. The intersections of columns 23*a* and 23*b* with rows 21*a* and 21*b* are squares or "cells" which contain indicia for placing a captured Goli (special attendant to the Maharaja and Rani) 26*a* or 26*b* which is not released by any Sapahi 28. The squares may be colored alternately light and dark or they may be all one color as desired. Two sets of 22 playing pieces are used, each set being of a different distinguishing color.

Each set of 22 pieces comprises one Maharaja 14, one Rani (wife of the Maharaja) 16, two Shahzadas (sons of the Maharaja) 18*a* and 18*g,* two Swars (Lancers of the Maharaja) 22*a* and 22*b,* two Jotshis (Astrologers of the Maharaja) 20*a* and 20*b,* two Rathwans (Maharaja's palace cart drivers) 24*a* and 24*b,* two Golis (special attendants of the Maharaja and Rani) 26*a* and 26*b,* and ten Sapahis (Soldiers of the Maharaja) 28*a* through 28*j.* Each piece represents an individual having a particular ability to move about the playing board in a particular manner to afford capture of an opponent's pieces and escape from an opponent's pursuit.

Figure 2A:
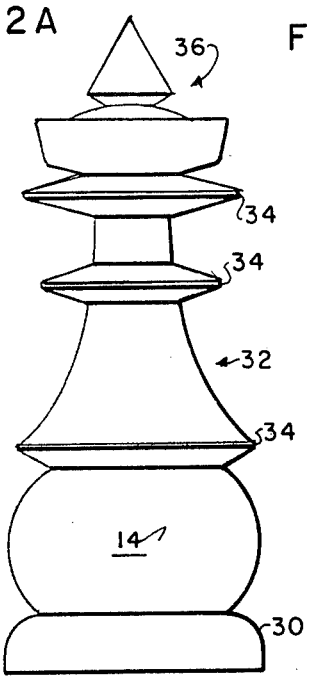
FIGS. 2 A through 2 H are elevational views of the typical playing pieces with their identifying names.

The Maharaja 14, or head of state, is represented by an arbitrary symbol as shown in FIG. 2A comprising a base portion 30, curved upper portion 32 having sharp protrusions 34 capped with a symbolic crown 36. This piece representing the Maharaja 14 has the power to move only one square in any direction. The Maharaja 14 is also permitted to move in an obstructed direction first one square along a row or column and then one square to an unobstructed square diagonally away from the point of beginning. However, this move is limited to only one per game and it may not capture an opponent's piece by that move. The Maharaja 14 or head of state is the piece which must be captured or be in a position where its capture is inevitable for one side to win.

Figure 2B:
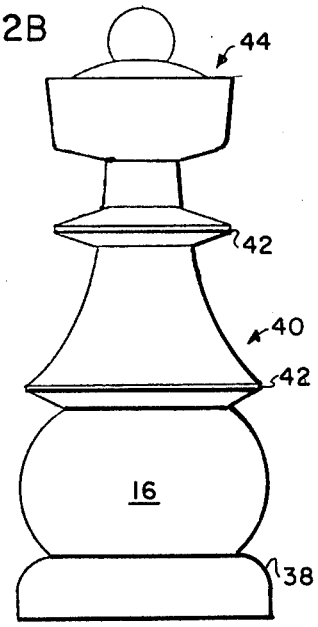

The Rani (wife of the Maharaja) 16, or next in line to become head of state, is represented by the arbitrary symbol as shown in FIG. 2B, and comprises a base 38 having a curved portion 40 having sharp protrusions 42 capped by a lesser distinct crown 44. The Rani (wife of the Maharaja) 16, because of her standing in the power structure, has the power to move in any direction, either along a column, row or diagonal, which is not obstructed by an opposing player's piece. She further has the ability to move along an obstructed path in which the first step is one square along either a column or a row, which may be obstructed by an opponent's piece, and then diagonally one square in a direction away from the beginning square of that move, which square may be either occupied or not occupied by an oponent's piece. If the end square is occupied by an opponent's piece, a capture results. A capture will also result if an opponent's piece occupies the square at the end of the move along any row, column or diagonal.

Figure 2C:
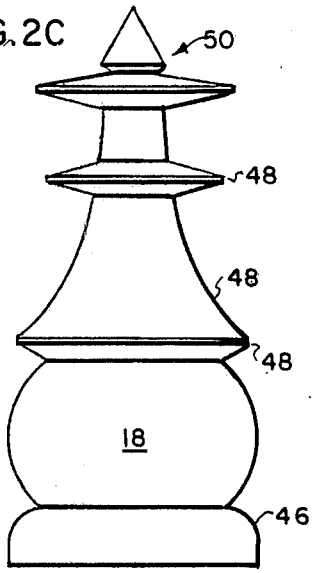

The Shahzada (son of the Maharaja) 18*a* or 18*b*, who also may ascend to become head of state, is represented by the arbitrary symbol as shown in FIG. 2C, being an object having a base portion 46 with various curves and protrusions 48 capped by a smaller crown 50 symbolizing an individual having somewhat lesser power. The Shahzada (son of the Maharaja) has the power to move in any unobstructed direction for any number of squares along either a column, a row or a diagonal, and can capture an opponent's piece when it occupies the end square of such a move.

Figure 2D:
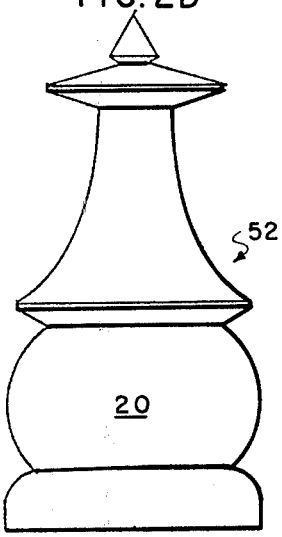

The Jotshi (astrologer of the Maharaja) 20*a* or 20*b*, who also has great influence over the Maharaja 14, is represented by the arbitrary symbol as shown in FIG. 2D, having a lesser number of curves and protrusions 52 to symbolize his lesser importance. The Jotshi (astrologer of the Maharaja) 20 has the ability to move in any unobstructed direction along a diagonal and capture an opposing piece in the square at the end of such a move.

Figure 2E:
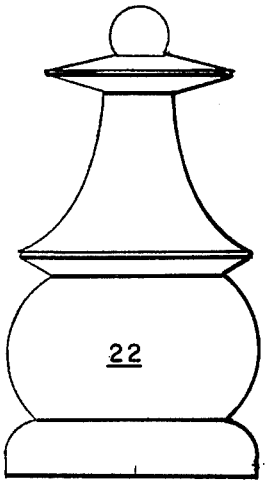

The Swar (lancer of the Maharaja) 22, having the ability to influence and protect the Maharaja 14 and his family, is represented by the arbitrary symbol as shown in FIG. 2E being somewhat smaller in size and less eleborate than the other pieces of greater power. The Swar (lancer of the Maharaja) has the ability to move in two steps over an obstructed path or unobstructed path in that, for the first step of the move, it can move one square along any row or column, which may be either obstructed or unobstructed, and then for the remaining step of the move, it can move one square diagonally away from the beginning square of the move, which, if the end square is occupied, will result in a capture of an opponent's piece.

Figure 2G:
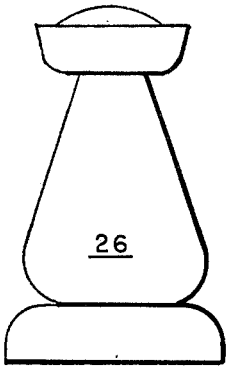
Figure 2F:
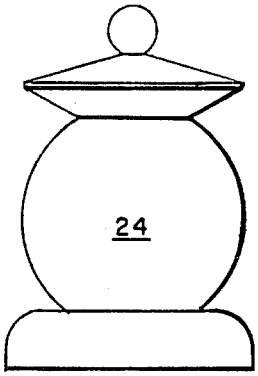

The Rathwan (Maharaja's palace cart driver) 24*a* or 24*b*, or other state official, is represented by the arbitrary symbol as illustrated in FIG. 2F and is also somewhat smaller and less elaborate than the members of state of higher rank. The Rathwan (Maharaja's palace cart driver) 24*a* or 24*b* has the ability to move in any direction along either a column or a row that is unobstructed and may capture an opponent's piece in the last square of that move.

The Goli (special attendant to the Maharaja and Rani) 26*a* or 26*b*, whose essential function is to protect the head of state and his family, is represented by the arbitrary symbol as shown in FIG. 2G. Each Goli (special attendant to the Maharaja and Rani) 26 has the ability to move one square in any direction and capture an opponent's piece if occupying that square.

Figure 2H:
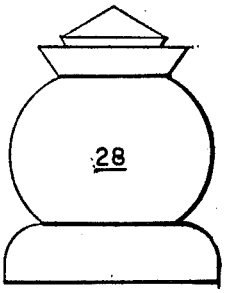

The Sapahi (soldier) 28, which is the lowest rank playing piece in the game, is represented by the symbol as shown in FIG. 2H. It has the ability to move only in one unobstructed direction one square along a column toward the opponent's side of the board and can capture an opponent's piece only by moving diagonally forward one square occupied by the opponent's piece.

The Sapahi (soldier) 28 has several peculiarities. It moves only forward one square at a time and never two, and when not capturing, advances only one square along the column. If it reaches the tenth row 15*a* or 15*j*, it will effect a release of a captured piece occupying the immediately adjacent square of row 21*a* or 21*b*, respectively. The released piece is then placed to occupy the square in row 15*a* or 15*j* reached by the Sapahi (soldier) and the Sapahi (soldier) is retired from the game. Thus a player cannot exceed the limit on the number of pieces he had at the start of the game. The Sapahi (soldier) 28 alone captures differently from its non-capturing move. It captures to either square that is diagonally adjacent in the direction of the opponent's side.

There is no castling in "Maharaja" chess. However, the Maharaja 14 is also allowed to move only once in the game, like a Swar (lancer of the Maharaja) 22, provided the Maharaja 14 did not yet move from its original position, and had not been in check before or at that time. However, by such a move, he is not allowed to capture any of the opponent's pieces.

To play the game, the pieces are initially arranged on the board as shown in FIG. 1 in which each of the two Rathwans (Maharaja's palace cart drivers) 24*a* and 24*b* are placed on the intersections of columns 17*a* and 17*j* with rows 15*a* and 15*j* near each opponent, each of the two Swars (lancers of the Maharaja) 22*a* and 22*b* is placed on the next inner square of row 15*a* or 15*j* where they intersect columns 17*b* and 17*i* near each opponent, each of the two Jotshis (Astrologers of the Maharaja) 20*a* and 20*b* is placed on the next inner square from each end in row 15*a* or 15*j* near each opponent, each of the two Shahzadas (sons of the Maharaja) 18*a* and 18*b* is placed on the next inner square on row 15*a* or 15*j* nearest each opponent, the Rani (wife of the Maharaja) 16 is placed on the next empty square to the right of the left Shahzada (son of the Maharaja) on row 15*a* or 15*j* near each opponent, and the Maharaja 14 is placed on the next empty square to the left of the right Shahzada (son of the Maharaja) on row 15*a* or 15*j* near each opponent. Each of the Golis (special attendants to the Maharaja and Rani) 26*a* and 26*b* is placed one in front of the Rani (wife of the Maharaja) 16, and one in front of the Maharaja 14 in row 15*b* or 15*i* near each opponent while each of the Sapahis (soldiers of the Maharaja) is placed in front of one of the remaining pieces. The game is commenced by one opponent moving his playing piece, such as a Sapahi (soldier) or Swar (lancer of the Maharaja), one move, which is then countered by a move by the other opponent.

As soon as a playing piece whose home position is in row 15*a* or 15*b* is captured, the captured piece is then placed in its appropriate "cell" in row 21*a* or 21*b* on the opposite side of the playing board from its home position. If a Sapahi 28 (soldier) from the opposite side of the board is able to traverse the playing board without being captured and reaches the tenth row, it then perfects a release of the captured piece it faces and the Saphai (soldier) and the released playing piece reverse positions with the Sapahi (soldier) now occupying the "cell" and the released piece occupying the square in front of the "cell". A captured Jotshi must occupy the same color "cell" as it did in the playing field. The released piece is then able to resume its maneuvers on the playing board.

At no time can a player have a greater number of playing pieces than he started with nor can he have a greater number of types of playing pieces than he started with. For example, he can have no more than one Rani, 2 Rathwans, 2 Swars, etc., nor can he have 2 Jotshis occupying the same color square.

For the twin playing pieces (Rathwan, Swar, Jotshi and Shahzada) the opponent capturing the piece decides in which of the two "cells" he will initially place the captured piece. If a release by the opponent's Sapahi (soldier) appears imminent, the captured piece cannot be moved to another "cell". If a Sapahi (soldier reaches the tenth row square in front of a vacant cell he cannot remain in front of the vacant cell but is lost from the game and must be removed from the board.

I claim:

1. A game apparatus comprising a playing board divided into a playing field of one hundred squares arranged in ten rows and ten columns, said board having a first opponent's side disposed parallel to said rows, and a second opponent's side disposed opposite said first opponent's side and parallel to said rows, a first set of playing pieces, each piece adapted to be placed on and fit within a square of said board, a second set of paying pieces visually distinguishable from said first set of playing pieces, each piece adapted to be placed on and fit within a square of said board, said first and said second sets of playing pieces each comprising two individual playing pieces which are visually distinguishable from each other and all other playing pieces of the set, five pairs of playing pieces each pair visually identical to each other and visually distinguishable from all other playing pieces of said set, ten playing pieces each visually identical to each other and visually distinguishable from all other playing pieces of said set, a first additional row of twelve squares disposed nearest said first opponent's side, said squares containing indicia indicting placement location of particular pieces selected from said two individual and five pairs of playing pieces, the second and eleventh squares of said first additional row disposed in alignment with the rightmost and leftmost columns, respectively, of said playing field and with the first and twelfth squares of said first additional row extending beyond the lateral sides of said playing field, and a second additional row of twelve squares disposed nearest said second opponent's side, said squares containing indicia indicating placement location of particular pieces selected from said two individual and five pairs of playing pieces, the second and eleventh squares of said second additional row disposed in alignment with said rightmost and leftmost columns, respectively, of said playing field and with the first and twelfth squares of said second additional row extending beyond the lateral sides of said playing field.

* * * * *